US006105252A

United States Patent [19]

Andis

[11] Patent Number: 6,105,252

[45] Date of Patent: Aug. 22, 2000

[54] RAZOR ASSEMBLY INCLUDING DETACHABLE AND VIBRATABLE HEAD

[75] Inventor: Matthew L. Andis, Wind Point, Wis.

[73] Assignee: Andis Company, Racine, Wis.

[21] Appl. No.: 09/178,867

[22] Filed: Oct. 26, 1998

[51] Int. Cl.[7] ..... B26B 19/28

[52] U.S. Cl. ..... 30/45; 30/44; 30/210

[58] Field of Search ..... 30/44, 45, 210, 30/539, DIG. 1

[56] References Cited

U.S. PATENT DOCUMENTS

| | | | |
|---|---|---|---|
| 4,083,102 | 4/1978 | Harshberger | 30/45 |
| 4,914,816 | 4/1990 | Fenn et al. | 30/45 |
| 5,007,169 | 4/1991 | Motta . | |
| 5,046,249 | 9/1991 | Kawara et al. | 30/45 |
| 5,214,851 | 6/1993 | Althaus | 30/45 |
| 5,299,354 | 4/1994 | Metcalf et al. | 30/45 |
| 5,732,470 | 3/1998 | Labarbara | 30/45 |

*Primary Examiner*—Hwei-Siu Payer
*Attorney, Agent, or Firm*—Michael Best & Friedrich LLP

[57] ABSTRACT

Disclosed herein is a razor assembly comprising a power unit including a rotatable output shaft, and a detachable head assembly adapted to receive a common disposable razor blade and comprising a hollow base received on the power unit in stationary relation thereto, and a rotatable member mounted in the hollow base for rotation relative to the base, in driven engagement with the output shaft so as to rotate in response to rotation of the output shaft, and including an eccentric weight rotating in common with the member and operable, in response to rotation of the member, to vibrate the detachable head assembly.

19 Claims, 3 Drawing Sheets

Fig. 8
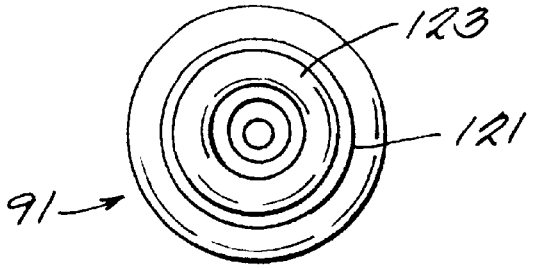
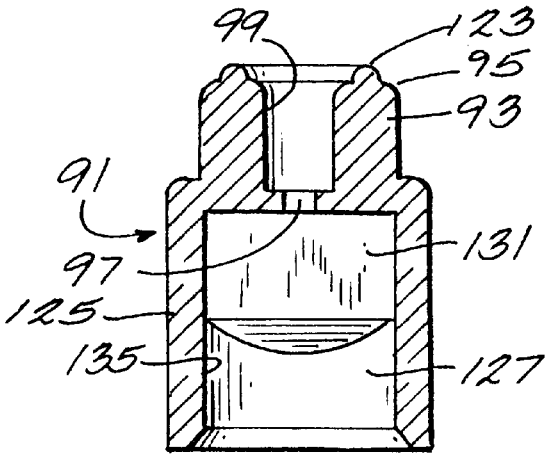
Fig. 7
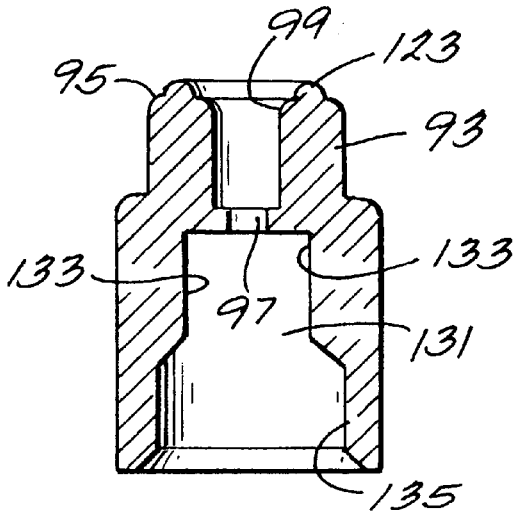
Fig. 10
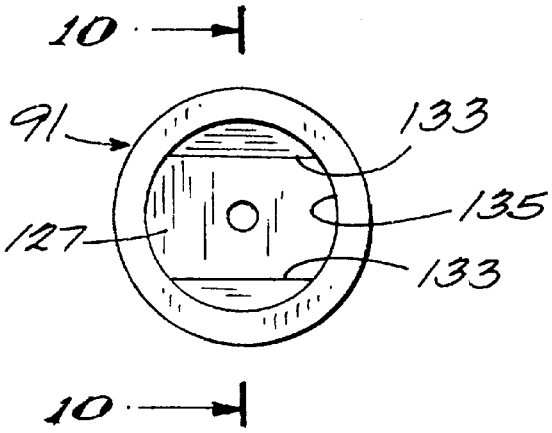
Fig. 9

RAZOR ASSEMBLY INCLUDING DETACHABLE AND VIBRATABLE HEAD

BACKGROUND OF THE INVENTION

The invention relates generally to razors and, more particularly, to razors which can be vibrated as desired. In the past, one piece razors have been available, which razors were vibratable when desired by an operator.

Also in the past, hand-held devices were available, which hand-held devices included power units including a rotatable output shaft and detachable heads for clipping hair and for trimming hair in the nostrils and in the ears of a user.

SUMMARY OF THE INVENTION

The invention provides a razor assembly comprising a power unit including a rotatable output shaft, and a detachable head assembly adapted to receive a common disposable razor blade and comprising a hollow base received on the power unit in stationary relation thereto, and a rotatable member mounted in the hollow base for rotation relative to the base, in driven engagement with the output shaft so as to rotate in response to rotation of the output shaft, and including an eccentric weight rotating in common with the member and operable, in response to rotation of the member, to vibrate the detachable head assembly.

The invention also provides a razor assembly comprising a power unit including a rotatable output shaft, and a detachable head assembly comprising a detachable head member including a hollow base received on the power unit in stationary relation thereto, and a bar part extending from the hollow base and adapted to receive a common disposable razor blade, a housing member located in the hollow base part in stationary engagement with the hollow base, and a rotatable member mounted in the hollow base for rotation relative to the base and including a coupling portion in driven engagement with the output shaft so as to rotate the rotatable member in response to rotation of the output shaft, and an eccentric weight connected to the coupling for common rotation therewith and operable, in response to rotation of the rotatable member, to vibrate the detachable head assembly.

The invention also provides a razor assembly comprising a power unit including a mounting portion, and a rotatable output shaft extending from the mounting portion, and a detachable head assembly comprising a detachable head member including a hollow base received on the mounting portion of the power unit in stationary relation thereto and including a cylindrical inner surface, and a bar extending from the base and adapted to receive a common disposable razor blade, a housing member located in the hollow base in stationary engagement with the cylindrical surface and including a bearing surface, and a rotatable member located in the housing member and including a coupling extending from the bearing surface and in driven engagement with the output shaft so as to rotate the rotatable member in response to rotation of the output shaft, a stud extending from the coupling for common rotation therewith and including a bearing surface in engagement with the bearing surface on the housing member, and an eccentric weight fixed on the stud for common rotation therewith and operable, in response to rotation of the rotatable member, to vibrate the detachable head.

The invention also provides a detachable head assembly adapted to receive a common disposable razor blade and to be received on a power unit including a rotatable output shaft, the detachable head assembly comprising a hollow base adapted to be received on the power unit in stationary relation thereto, and a rotatable member mounted in the hollow base for rotation relative to the base and adapted for driven engagement with the output shaft so as to rotate in response to rotation of the output shaft, and including an eccentric weight rotating in common with the member and operable, in response to rotation of the member, to vibrate the detachable head assembly.

The invention also provides a detachable head assembly adapted to receive a common disposable razor blade and to be received on a power unit including a rotatable output shaft, the detachable head assembly comprising a detachable head member including a hollow base received on the power unit in stationary relation thereto, and a bar part extending from the hollow base and adapted to receive a common disposable razor blade, a housing member located in the hollow base part in stationary engagement with the hollow base, and a rotatable member mounted in the hollow base for rotation relative to the base and including a coupling portion adapted for driven engagement by the output shaft so as to rotate the rotatable member in response to rotation of the output shaft, and an eccentric weight connected to the coupling for common rotation therewith and operable, in response to rotation of the rotatable member, to vibrate the detachable head assembly.

The invention also provides a detachable head assembly adapted to receive a common disposable razor blade and to be received on a power unit including a rotatable output shaft, the detachable head assembly comprising a detachable head member including a hollow base adapted to be received on a mounting portion of the power unit in stationary relation thereto and including a cylindrical inner surface, and a bar extending from the base and adapted to receive a common disposable razor blade, a housing member located in the hollow base in stationary engagement with the cylindrical surface and including a bearing surface, and a rotatable member located in the housing member and including a coupling extending from the bearing surface and in driven engagement with the output shaft so as to rotate the rotatable member in response to rotation of the output shaft, a stud extending from the coupling for common rotation therewith and including a bearing surface in engagement with the bearing surface on the housing member, and an eccentric weight fixed on the stud for common rotation therewith and operable, in response to rotation of the rotatable member, to vibrate the detachable head.

Other features and advantages of the invention will become apparent to those skilled in the art upon review of the following detailed description, claims and drawings.

DESCRIPTION OF THE DRAWINGS

FIG. 7 is a sectional view of a rotatable member incorporated in the razor shown in FIGS. 1 and 2.

FIG. 8 is a top plan view of the rotatable member shown in FIG. 7.

FIG. 9 is a bottom plan view of the rotatable member shown in FIG. 7.

FIG. 10 is a sectional view taken along line 10—10 of FIG. 9.

Figure 1:
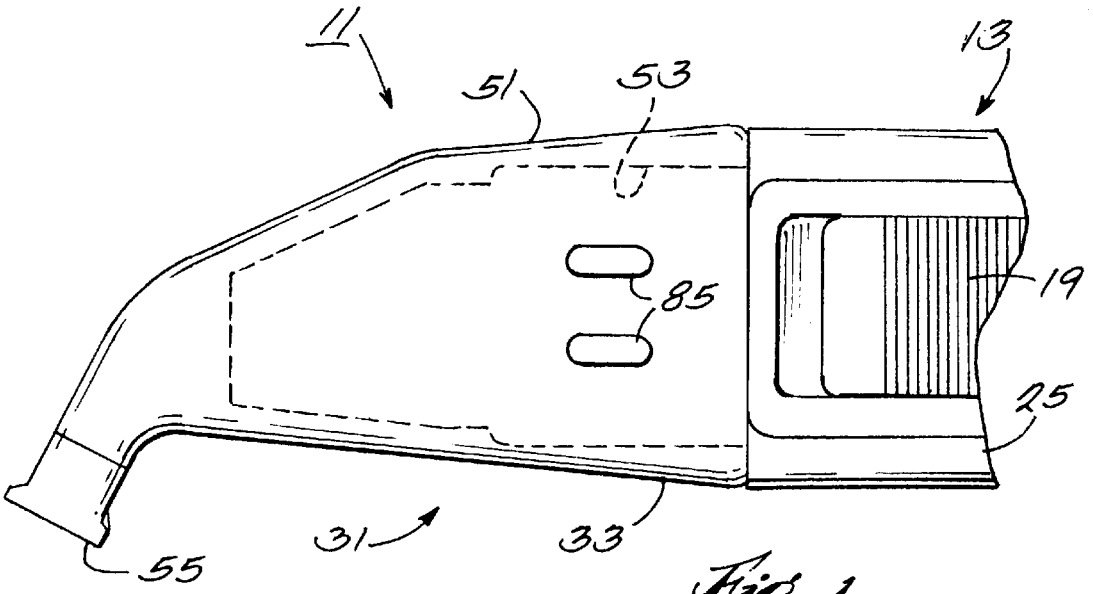
FIG. 1 is a fragmentary side elevational view of a razor which comprises a detachable and vibratable head and which includes various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in the drawings is a razor assembly 11 comprising a power unit 13 including a rotatable output shaft or member 15 which is driven or rotated by any suitable electrically powered arrangement including a suitable electric motor (not shown) and a suitable off-on switch 19. Either battery power or ordinary plug-in power can be employed. The output shaft 15 includes a cylindrical surface or portion 21 which is adapted to be received in a socket, still to be described, and a drive ball or portion 23 which extends outwardly from the cylindrical portion 21 in eccentric relation thereto and which is adapted to engage the socket to effect, in response to rotation of the output shaft 15, rotation of a rotatable member still to be described.

The power unit 13 also includes a housing 25 which can be of any suitable construction and which is preferably fabricated of a suitable electrically insulating plastic. Such power units are old and known in the art.

The razor assembly 11 also includes a detachable head assembly 31 adapted to receive a common disposable razor blade (not shown) and comprises a hollow base, base part, or portion 33 received on the power unit 13 in removably stationary relation thereto. Mounted in the base portion 33 is a rotatable assembly 41 which is in driven engagement with the output shaft 15 so as to rotate the rotatable assembly 41 relative to the base portion 33 in response to rotation of the output shaft 15. The rotatable assembly 41 includes an eccentric weight 45 which, in response to rotation of the rotatable assembly 41, causes vibration of the detachable head assembly 31.

More particularly, the detachable head assembly 31 includes a detachable head member 51 which is preferably fabricated of an electrically insulating plastic which includes the before mentioned base part or portion 33. The base part or portion 33 includes a cylindrical inner wall or surface 53 which is removably engageable on the power unit 13 in stationary relation thereto. In addition, the detachable head member 51 also includes a bar, a bar part, or portion 55 which extends from the hollow base part or portion 33 and which is adapted to slidably receive a common disposable razor blade (not shown).

Means are provided to releaseably retain the detachable head member 51 on the power unit 13. While other constructions can be employed, in the disclosed construction, such means includes, on the power unit housing 25, a mounting portion 61 adapted to receive the detachable head member 51 and comprising two arcuately spaced and diametrically oppositely located annular rib segments 63 which are spaced by diametrically opposite voids or openings and which respectively include partial, generally cylindrical outer surfaces. Located in the cylindrical outer surfaces in spaced relation to the voids or spaces are respective diametrically oppositely located detent holes or recesses 67.

In the disclosed construction, the means for releaseably retaining the detachable head member 51 on the power unit 13 also includes, on the hollow base part or portion 33, a cylindrical inner surface including a pair of diametrically spaced inwardly projecting ribs or projections 71 located to pass through the voids or spaces between the annular rib segments 63 of the mounting portion 61 of the power unit 13 and, incident to rotation of the detachable head member 51 relative to the power unit 13, to be removably engaged in the detente holes or recesses 67 of the mounting portion 61 of the power unit 13 to prevent unwanted detachment of the detachable head assembly 31 from the power unit 13.

Located in the hollow base part or portion 33 of the detachable head member 51 in stationary engagement with the cylindrical inner wall or surface 53 of the hollow base part or portion 33 is (see especially FIGS. 3 through 6) a stationary shell or housing member 75 which is also preferably fabricated of a suitable electrically insulating plastic and which is generally of cup-shape including a cylindrical wall 77 and a transverse wall or web 79 located outwardly of the cylindrical wall 77 in the direction of the axis of the output shaft 15. The cylindrical wall 77 includes an outer generally cylindrical surface in engagement with the cylindrical inner wall or surface 53 of the base part or portion 33 of the detachable head member 51.

In addition, the stationary shell or housing member 75 also includes a generally annularly shaped bearing or journal portion 81 which extends outwardly from the transverse wall or web 79 in the general direction of the output shaft 15 and which includes a pair of arcuately spaced and diametrically oppositely located bearing segments 82 each including an inner partially cylindrical bearing surface 83.

Means are provided to prevent relative movement between the detachable head member 51 and the stationary shell or housing member 75. While other constructions can be employed, in the disclosed construction, such means includes, in the cylindrical inner surface or wall 53 of the base portion or part 33 of the detachable head member 51, (see FIG. 1) a pair of diametrically oppositely located slots or recesses 85 which extend in the direction of the axis of the output shaft 15 and which are spaced inwardly from the inner cylindrical surface edge located adjacent to the power unit 13.

In addition, in the disclosed construction, the means for preventing relative rotation between the detachable head member 15 and the shell or housing member 75 also includes, on the cylindrical wall 77 of the shell or housing member 75, a pair of diametrically oppositely located ribs or projections 87 which extend in the direction of the axis of the output shaft 15 and which are located in the slots or recesses 85 of the cylindrical inner surface or wall 53 of the detachable head member 51.

Located in the shell or housing member 75 for rotation relative to the shell or housing member 75 and to the detachable head member 51 is (see especially FIGS. 7 through 10) a generally cylindrically shaped rotatable holder or member 91 which extends generally in the direction of the axis of the output shaft 15 and which includes an axially outer end portion 93 including an outer surface 95 extending transversely to the direction of the axis of the output shaft 15 and an axially outwardly extending bore 97 and counterbore 99 extending in the general direction of the axis of the output shaft 15.

Figure 2:
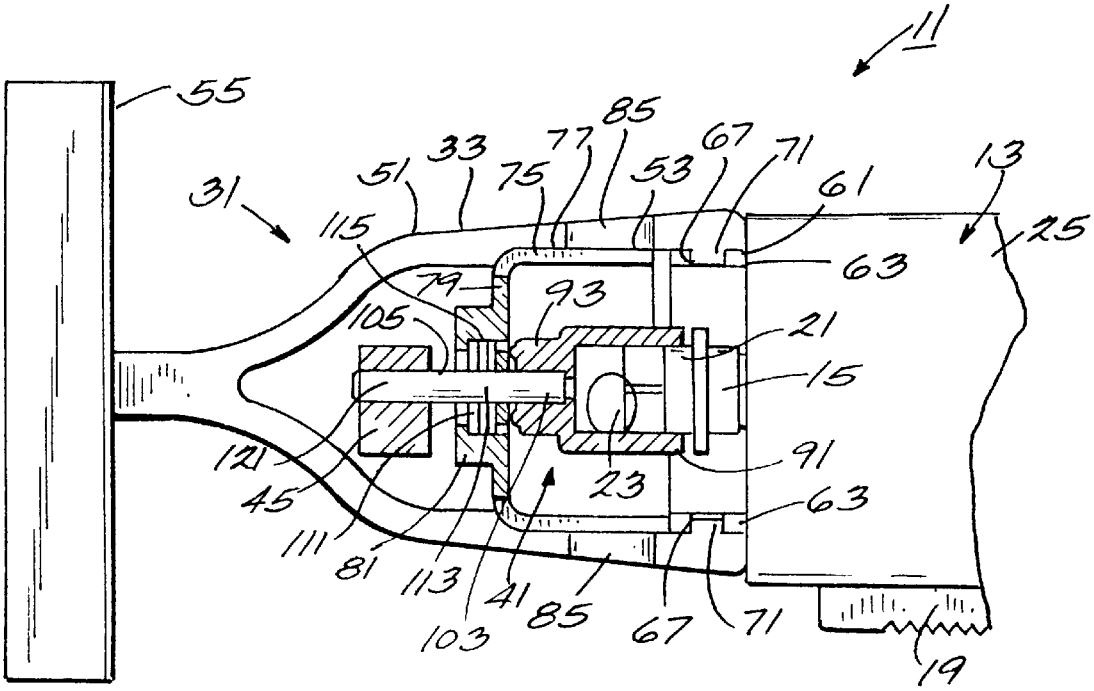
FIG. 2 is a top plan view, partially in section, of the razor shown in FIG. 1.
Figure 3:
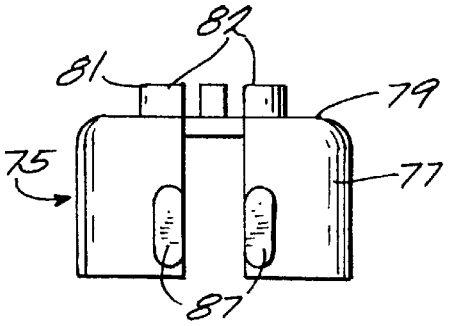
FIG. 3 is a side elevational view of a stationary shell or housing member incorporated in the razor shown in FIGS. 1 and 2.
Figure 4:
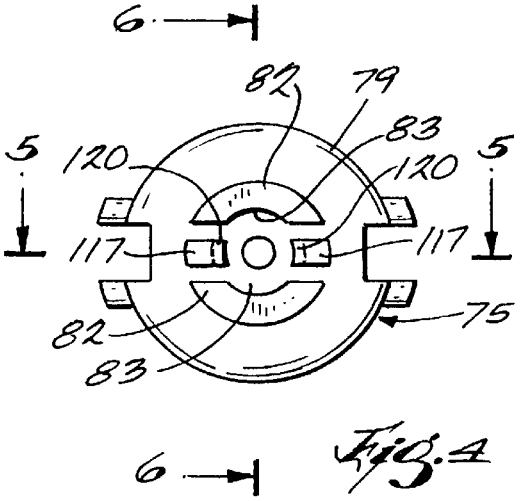
FIG. 4 is a top plan view of the shell or housing member shown in FIG. 3.
Figure 5:
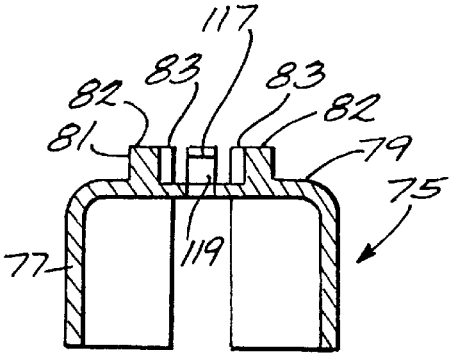
FIG. 5 is a sectional view taken along line 5—5 of FIG. 4.
Figure 6:
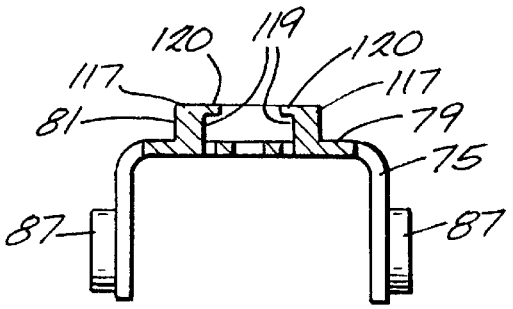
FIG. 6 is a sectional view taken along line 6—6 of FIG. 4.

Fixed in the outwardly extending counterbore 99 of the holder or rotatable member 91 for common rotation with the holder or rotatable member 91, by any suitable means, such as by press fitting, is (see FIG. 2) an axially inner end portion 103 of a stud or shaft or pin 105 which, preferably, is fabricated of steel. The pin or shaft 105 also includes an outer end portion 121 having fixed thereon for common rotation, the before mentioned eccentric weight 45 which is preferably fabricated of a light material, such as aluminum, which can be of any suitable construction, and which, in response to rotation of the rotatable holder or member 91, causes vibration of the detachable head assembly 31.

Means are provided for affording rotation of the holder or rotatable member 91 relative to the stationary shell or housing member 75, for retaining the stationary shell or housing member 75 and the holder or rotatable member 91 in assembled relation, and for affording a certain amount of wobble movement of the holder or rotatable member 91 relative to the stationary shell or housing member 75.

While other constructions can be employed, in the disclosed construction, the means for affording rotation of the holder or rotatable member 91 relative to the stationary shell or housing member 75 comprises the before mentioned bearing surface 83, journal portion 81 of the stationary shell or housing 75 and (see FIG. 2) inclusion on the stud or shaft or pin 105 of a ring or washer 111 which, preferably, is fabricated from brass, which is fixed to a central portion 113 of the stud shaft or pin 105 for common rotation therewith, and which has an outer or peripheral cylindrical bearing surface in bearing engagement with the bearing surface 83 of the journal portion 81 of the stationary shell or housing member 75.

While other constructions can be employed, in the disclosed construction, the means for retaining the stationary shell or housing member 75 and the holder or rotatable member 91 in assembled relation comprises (see FIGS. 4 and 6) formation on the outer transverse wall or web 79 of the stationary shell or housing 75 of a pair of diametrically oppositely located tabs 117 which form part of the journal portion 81, which extend outwardly in the spaces between the bearing segments 82, which include inner partially cylindrical bearing surfaces 119 in engagement with the peripheral bearing surface 115 of the ring or washer 111, and which also include radially inwardly and resiliently projecting locking ears or portions 120 extending into slightly overlying and engaging relation to the ring or washer 111 to retain the assembled relation of the stationary shell or housing 75 and the holder or rotatable member 91 while affording relative rotation therebetween.

While other constructions can be employed, in the disclosed construction, the means for affording a certain amount of wobble movement of the holder or rotatable member 91 relative to the stationary shell or housing member 75 comprises formation (see FIGS. 7, 8, and 10) on the outer transverse surface 95 of the holder or rotatable member 91 of an annular rocking ring 123 which engages the underside of the transverse web or wall 79 of the stationary shell or housing member 75 and which has a generally semi-circular cross-section in the direction extending radially with respect to the general direction of the axis of the output shaft 15.

Means are provided for connecting the output shaft 15 and the holder or rotatable member 91 and for rotating the holder or rotatable member 91 in response to rotation of the output shaft 15. While other constructions can be employed, in the disclosed construction, such means comprises formation of the holder or rotatable member 91 to include an inner or coupling portion 125 which extends inwardly from the outer end portion 121 and which includes an inwardly open socket 127 receiving the output shaft 15 in driven engagement so as to rotate the holder or rotatable member 91 in response to rotation of the output shaft 15.

More particularly, the inwardly extending socket 127 includes an inwardly extending slot or recess 131 which is defined by a pair of parallel walls 133 spaced so as to receive therebetween, in dual driving engagement, the drive ball or portion 23 of the output shaft 15. In addition, the socket 127 includes a counter bore 135 which extends inwardly from the slot or recess 131 and which is dimensioned to receive the cylindrical portion 21 of the output shaft 15.

As a consequence, upon rotation of the output shaft 15 by actuation of the switch 19 on the power unit 13, the holder or rotatable member 91 is rotatably driven. In turn, such rotation of the holder or rotatable member 91 causes common rotation of the eccentric weight 45 so as to vibrate the detachable head assembly 31. The speed of the output shaft or member 15 is chosen to impart to the detachable head assembly 31 a vibration with a high frequency and a small amplitude which is, nevertheless, sufficient to cause vibratory movement of the relatively light weight detachable head assembly 31 without noticeably vibrating the much heavier power unit 13.

Various of the features are set forth in the following claims.

What is claimed is:

1. A razor assembly comprising a power unit including a mounting portion, and a rotatable output shaft extending from said mounting portion, and a detachable head assembly comprising a detachable head member including a hollow base received on said mounting portion of said power unit in stationary relation thereto and including a cylindrical inner surface, and a bar extending from said base and adapted to receive a disposable razor blade, a housing member located in said hollow base in stationary engagement with said cylindrical surface and including a bearing surface, and a rotatable member located in said housing member and including a coupling extending from said bearing surface and in driven engagement with said output shaft so as to rotate said rotatable member in response to rotation of said output shaft, a stud extending from said coupling for common rotation therewith and including a bearing surface in engagement with said bearing surface on said housing member, and an eccentric weight fixed on said stud for common rotation therewith and operable, in response to rotation of said rotatable member, to vibrate said detachable head assembly.

2. A razor assembly in accordance with claim 1 wherein said detachable head member and said housing member include means for preventing relative movement therebetween.

3. A razor assembly in accordance with claim 2 wherein said means for preventing relative movement between said detachable head member and said housing member includes a rib on one of said detachable head member and said housing member, and a recess located in the other of said detachable head member and said housing member and releaseably receiving said rib.

4. A razor assembly in accordance with claim 1 wherein said power unit and said detachable head assembly include means for releaseably retaining said detachable head assembly on said power unit.

5. A razor assembly in accordance with claim 4 wherein said means releaseably retaining said detachable head assembly on said power unit includes a rib on one of said detachable head assembly and said power unit, and a recess located in the other of said detachable head assembly and said power unit and receiving said rib.

6. A razor assembly in accordance with claim 1 wherein said output shaft and said rotatable member include means for rotating said rotatable member in response to rotation of said output shaft, said means comprising, on said output shaft, a drive portion in eccentric relation thereto, and, on said rotatable member, a socket including a pair of spaced parallel walls receiving said drive portion in driving engagement to so as to effect eccentric rotation of said rotatable member in response to rotation of said output shaft.

7. A razor assembly in accordance with claim 1 wherein means are provided on said rotatable member and on said housing member for affording rotation of said rotatable member relative to said housing member, for retaining said housing member and said rotatable member in assembled relation, and for affording wobble movement of said rotatable member relative to said housing member.

8. A razor assembly comprising a power unit including a rotatable output shaft, a detachable head assembly adapted to receive a disposable razor blade and including a hollow base received on said power unit in stationary relation thereto, a rotatable member mounted in said hollow base for rotation relative to said base, means for rotating said rotatable member in response to rotation of said output shaft, said means including, on one of said rotatable member and said output shaft, a socket including a pair of spaced walls receiving the other of said rotatable member and said output shaft so as to effect eccentric rotation of said rotatable member in response to rotation of said output shaft, and an eccentric weight rotating in common with said rotatable member and operable, in response to rotation of said member, to vibrate said detachable head assembly.

9. A razor assembly in accordance with claim 8 wherein said power unit and said detachable head assembly include means for releaseably retaining the detachable head assembly on said power unit.

10. A razor assembly comprising a power unit including a rotatable output shaft, and a detachable head assembly comprising a detachable head member including a hollow base received on said power unit in stationary relation thereto, and a bar part extending from said hollow base and adapted to receive a disposable razor blade, a housing member located in said hollow base in stationary engagement with said hollow base, and a rotatable member mounted in said hollow base for rotation relative to said base and including a coupling portion in driven engagement with said output shaft so as to rotate said rotatable member in response to rotation of said output shaft, and an eccentric weight connected to said coupling portion for common rotation therewith and operable, in response to rotation of said rotatable member, to vibrate said detachable head assembly.

11. A razor assembly in accordance with claim 10 wherein said detachable head member and said housing member include means for preventing relative movement therebetween.

12. A razor assembly in accordance with claim 11 wherein said means for preventing relative movement between said detachable head member and said housing member includes a rib on one of said detachable head member and said housing member, and a recess located in the other of said detachable head member and said housing member and releaseably receiving said rib.

13. A razor assembly in accordance with claim 10 wherein said power unit and said detachable head assembly include means for releaseably retaining the detachable head assembly on said power unit.

14. A razor assembly in accordance with claim 13 wherein said means releaseably retaining the detachable head assembly on said power unit includes a rib on one of said detachable head assembly and said power unit, and a recess located in the other of said detachable head assembly and said power unit and receiving said rib.

15. A razor assembly in accordance with claim 10 wherein said output shaft includes a drive portion and wherein said rotatable member includes a socket including a pair of spaced walls receiving said drive portion of said output shaft.

16. A razor assembly in accordance with claim 10 wherein means are provided on said rotatable member and on said housing member for affording rotation of said rotatable member relative to said housing member, for retaining said housing member and said rotatable member in assembled relation, and for affording wobble movement of said rotatable member relative to said housing member.

17. A detachable head assembly adapted to receive a disposable razor blade and to be received on a power unit including a rotatable output shaft, said detachable head assembly comprising a hollow base adapted to be received on the power unit in stationary relation thereto, and a rotatable member supported by said hollow base for rotation relative to said base and having a coupling portion adapted to be engaged with the output shaft so as to rotate in response to rotation of the output shaft, and including an eccentric weight rotating in common with said member and operable, in response to rotation of said member, to vibrate said detachable head assembly.

18. A detachable head assembly adapted to receive a disposable razor blade and to be received on a power unit including a rotatable output shaft, said detachable head assembly comprising a detachable head member including a hollow base to be received on said power unit in stationary relation thereto, and a bar part extending from said hollow base and adapted to receive a disposable razor blade, a housing member located in said hollow base in stationary engagement with said hollow base, and a rotatable member mounted in said hollow base for rotation relative to said base and including a coupling portion adapted for driven engagement by the output shaft so as to rotate said rotatable member in response to rotation of the output shaft, and an eccentric weight connected to said coupling portion for common rotation therewith and operable, in response to rotation of said rotatable member, to vibrate said detachable head assembly.

19. A detachable head assembly adapted to receive a disposable razor blade and to be received on a power unit including a rotatable output shaft, said detachable head assembly comprising a detachable head member including a hollow base adapted to be received on a mounting portion of the power unit in stationary relation thereto and including a cylindrical inner surface, and a bar extending from said base and adapted to receive a disposable razor blade, a housing member located in said hollow base in stationary engagement with said cylindrical surface and including a bearing surface, and a rotatable member located in said housing member and including a coupling extending from said bearing surface and in driven engagement with the output shaft so as to rotate said rotatable member in response to rotation of the output shaft, a stud extending from said coupling for common rotation therewith and including a bearing surface in engagement with said bearing surface on said housing member, and an eccentric weight fixed on said stud for common rotation therewith and operable, in response to rotation of said rotatable member, to vibrate said detachable head assembly.

* * * * *